United States Patent [19]

Moody

[11] Patent Number: 4,727,883

[45] Date of Patent: Mar. 1, 1988

[54] JEWELRY MOUNTING CONSTRUCTION

[75] Inventor: Leonardo Moody, Downers Grove, Ill.

[73] Assignee: Luc-Co., Inc., Chicago, Ill.

[21] Appl. No.: 2,134

[22] Filed: Jan. 12, 1987

Related U.S. Application Data

[60] Division of Ser. No. 832,843, Feb. 24, 1986, Pat. No. 4,655,055, which is a continuation of Ser. No. 728,447, Apr. 30, 1985, Pat. No. 4,574,595, which is a division of Ser. No. 460,284, Jan. 24, 1983, abandoned.

[51] Int. Cl.[4] ..... A44C 1/00; A44C 27/00

[52] U.S. Cl. ..... 63/20; 24/150 R; 63/29 R

[58] Field of Search ..... 63/20, DIG. 3, 29 R, 63/14 D, 12, 14 E, 1 A, 1 R; 24/150 R, 155 R; 403/361; 156/294, 344; 29/DIG. 1, 10, 160.6; 411/303

[56] References Cited

U.S. PATENT DOCUMENTS

| | | | |
|---|---|---|---|
| 357,020 | 2/1987 | Nagle | 63/20 |
| 440,364 | 11/1890 | Perraud | 24/150 R |
| 569,053 | 10/1896 | Prokop | 63/20 |
| 996,003 | 6/1911 | Confrey | 24/155 R |
| 3,053,061 | 9/1962 | French | 63/29 R |
| 3,176,364 | 4/1965 | Dritz | 63/29 R |
| 3,605,438 | 9/1971 | Chalson | 63/12 |
| 3,789,850 | 2/1974 | Ford | 63/12 |
| 4,218,894 | 8/1980 | Tropea | 63/29 R |
| 4,353,225 | 10/1982 | Rogers | 63/29 R |

FOREIGN PATENT DOCUMENTS

| | | | |
|---|---|---|---|
| 720335 | 5/1942 | Fed. Rep. of Germany | 63/12 |

*Primary Examiner*—Richard J. Johnson

*Attorney, Agent, or Firm*—Allegretti, Newitt, Witcoff & McAndrews, Ltd.

[57] ABSTRACT

An improved jewelry mounting construction for use in adapted piered-ear earrings into earrings capable of being clamped on unpierced ears. Also disclosed is a construction for adapting pierced-ear earings into stickpins. The improved construction comprises a clamping mechanism for securing a medium between opposed surfaces, one of those opposed surfaces being a receptacle for an earring post, with the receptacle having a means for securing the earring post of a pierced-ear earring therein. The mechanism for adapting pierced-ear earrings into stickpins comprises a post receptacle affixed to an elongated pin, with a means for securing an earring post therein.

4 Claims, 8 Drawing Figures

JEWELRY MOUNTING CONSTRUCTION

This application is a division of parent application Ser. No. 832,843, filed Feb. 24, 1986, now U.S. Pat. No. 4,655,055 which in turn is a continuation of application Ser. No. 728,447 filed Apr. 30, 1985, now U.S. Pat. No. 4,574,595 application Ser. No. 728,444 was itself a continuation of application Ser. No. 460,284 filed Jan. 24, 1983, now abandoned.

BACKGROUND OF THE INVENTION

This invention relates to a jewelry mounting construction especially adapted for incorporation with earring clamps and stickpins, and more specifically relates to a device for converting pierced-ear earrings into earrings capable of being clamped to unpierced ears, or into a stickpin.

Earrings have traditionally been available for use in pierced ears, or in unpierced ears. Pierced-ear earrings typically consist of a decorative object attached to a pin-like post; occasionally, piecrced-ear earrings consist of a decorative object attached to a hooked pin or rod. When earrings are prepared with a post, they are conventionally secured to an earlobe by inserting the post through a hole pierced through an earlobe, and thereafter clamping an anchor attachment onto the post behind the earlobe so that the earring post cannot be removed from the ear without removing the anchor from the earring post. Earrings produced for use on earlobes that are not pierced must employ some form of clamping means attached to a decorative object, with the clamping means used to affix the decorative object to an earlobe. Normally, pierced ear earrings cannot be used on an ear that has not been pierced.

One aspect of the current jewelry industry is that the selection of pierced ear earrings far exceeds the selection of earrings adapted for use on unpierced ears. Moreover, the majority of higher quality decorative earrings are of the pierced ear type. Hence, persons desiring to wear earrings, but unable or unwilling to have their ears pierced, have a more limited selection of earrings to choose from.

Stickpins are forms of jewelry normally consisting of a decorative object attached to a long rod or pin with a pointed end. The rod or pin is inserted through clothing, and secured underneath the clothing, thereby allowing a person's decorative jewelry to be displayed wherever a person chooses. A limited selection of stickpins is, however, normally available. Moreover, stickpins are often sold as novelty items so that the quality of the decorative portion contained on a stickpin is often less than what an individual may desire.

Before this invention, persons without pierced ears who desired to use the decorative portion of a pierced-ear earring in nonpierced ear earrings, or as stickpins, were required to remove the decorative portion of the pierced-ear earring from the earring post or hook, and re-attach that decorative portion to a new clamp, such as the clamp disclosed in Saccoccio, U.S. Pat. No. 3,176,475 or to a stickpin. This is a delicate and somewhat tedious operation that usually can be accomplished only by a jeweler. Hence, persons desiring to use pierced-ear earring decorative portions have usually been required to take their chosen pieced-ear earrings to a jeweler for modification, with the delay and expense naturally attending to that action. Further, when decorative objects, such as diamonds, pearls, and delicately wrought precious metals, are removed from earrings, the operation unless skillfully performed, may result in damage or disfiguration of the decorative portion of the earring.

An object of this invention is therefore to provide an improved jewelry mounting construction for securing a decorative item onto the body or any apparel.

A further object of this invention is to provide an improved jewelry mounting construction capable of attaching pierced-ear earrings on nonpierced ears, and capable of supporting the decorative portion of a pierced-ear earring without removing that decorative portion from the earring post.

Another object of this invention is to provide an improved jewelry mounting construction for use as a stickpin.

Still another object of this invention is to provide an improved jewelry mounting construction for use as a stickpin receptacle capable of receiving the post or straightened hook attacked to the decorative portion of a pierced ear earring.

SUMMARY OF THE INVENTION

These and other objects of the invention are accomplished by providing an improved jewelry mounting construction usable with an earring clamp or a stickpin. As an earring clamp, the mounting construction comprises a receptacle for receiving a pierced-ear earring post; in the preferred embodiment, the receptacle has a generally cylindrical bore in which the earring post may be inserted. The earring clamp also includes means for securing the earring post in the receptacle bore, and a pincer jaw adapted to clasp an earlobe between the pincer jaw and the earring post receptacle. The clamping action of the improved earring clamp is provided by a leafspring affixed to the pincer jaw, and is elastically operated through motion of a leaver attached to spanning arm between the receptacle and the pincer jaw. In the preferred embodiment, the means for securing the earring post in the post receptacle is an elastic material affixed to the interior of the post receptacle bore, so that insertion of the earring post compresses the elastic material and produces frictional resistance to sliding movement of the post within the post receptacle bore. In an alternative embodiment, the post receptacle is filled with an elastic material that is puncturable and yieldable, such as an elastomeric adhesive.

The objects of this invention are also accomplished with a stickpin embodiment comprising a elongated pin or rod with a pointed end, and a second end affixed to a tubular earring post receptacle. The earring post receptacle has a means for securing the earring post in the receptacle, and the stickpin further comprises a pin retention attachment mountable on the pin at the stickpin's pointed end, to secure the stickpin in place when the stickpin has been attached to clothing or the like. In the preferred embodiment, the means for securing the earring post in the post receptacle comprises an elastic material affixed within the the center of the tubular post receptacle, so that insertion of the earring post into the post receptacle compresses the elastic material and produces frictional resistance to sliding movement of the earring post in the post receptacle.

BRIEF DESCRIPTION OF THE DRAWINGS

Two embodiments of the present invention are disclosed in the detailed description and drawings. The drawings include 6 figures to illustrate both embodiments, wherein like reference numerals in each drawing refer to like parts of the various embodiments. The drawings are briefly described as follows.

In the detailed description, directional terms such as "upper", and "lower" and the like, are used to relate the invention to the earlobe of a person oriented in the normally erect position. Terms of this type are used for the convenience of the person of ordinary skill in the art, and are not to limit the scope of any patent issuing on the present invention, unless expressly included in the claims.

DETAILED DESCRIPTION OF THE PREFERRED EMBODIMENT

The present invention is a mounting construction for mounting jewelry on a persons body, or on an item of apparel. The jewelry is of the kind having a straight post for a support. Generally, the invention comprises a receptacle for receiving the support post of a piece of jewelry, and an attachment means for attaching the receptacle and jewelry to a part of the body, or to apparel. The receptacle is connected to the attachment means by being affixed to a support stud affixed to the attachment means.

Figure 1:
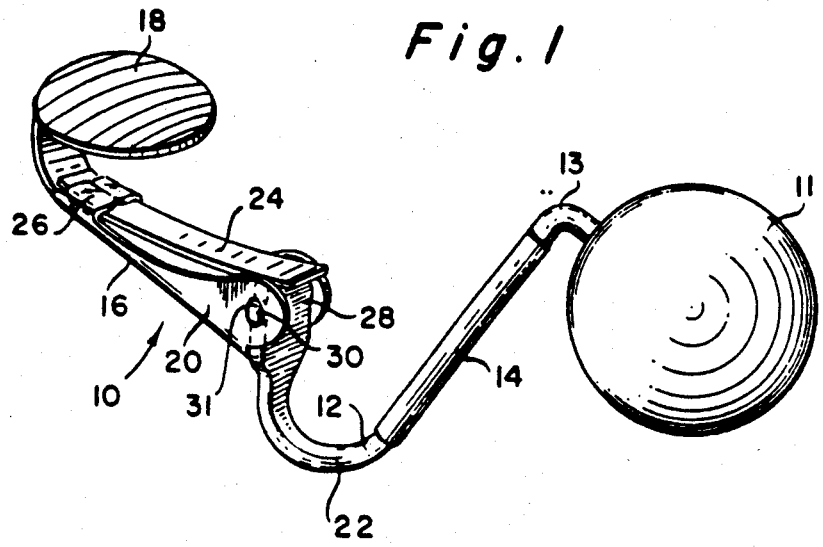
FIG. 1 is a side perspective view of the preferred embodiment of the invention depicting the improved earring clamp with a tubular earring post receptacle.
Figure 2:
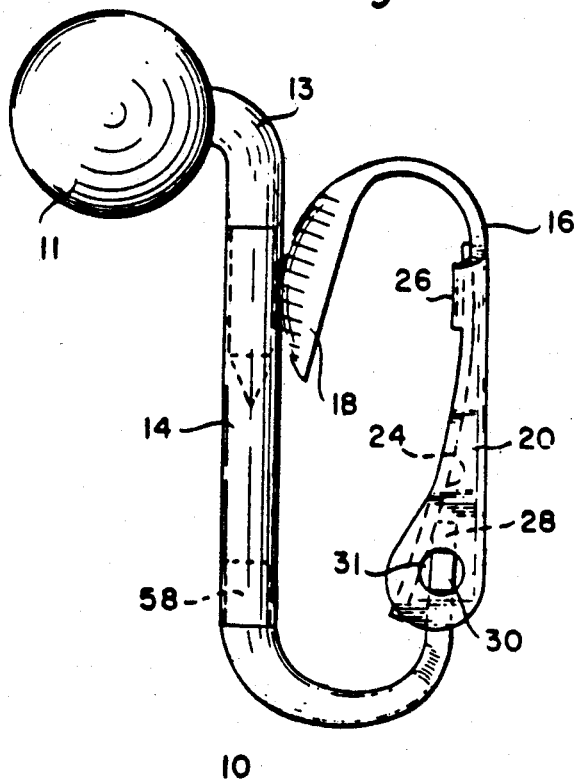
FIG. 2 is a side elevation of the earring clamp depicted in FIG. 1, showing operation of the leafspring mechanism.
Figure 4:
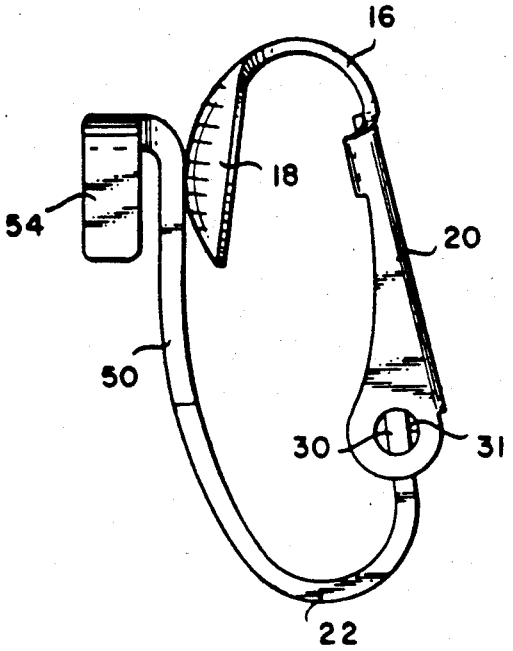
FIG. 4 is a side elevation of a second embodiment of the improved earring clamp.
Figure 5:
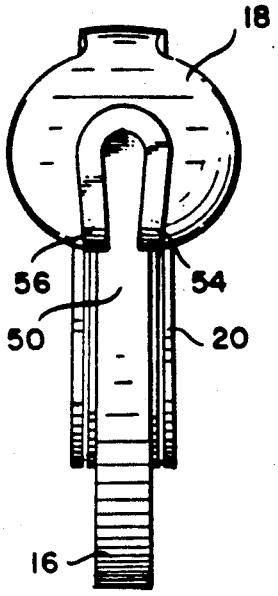
FIG. 5 is a front plan view of the second embodiment depicted in FIG. 4.
Figure 6:
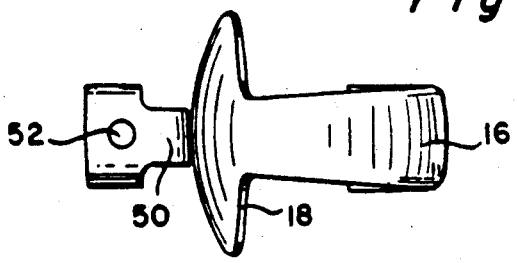
FIG. 6 is a top plan view of the second embodiment depicted in FIGS. 4 and 5.

Referring to FIGS. 1 and 2 of the accompanying drawings, a preferred embodiment of the present invention is incorporated in an earring clamp 10, so that the attachment means comprises a clamp for attaching jewelry to an earlobe. An alternative embodiment of the invention is shown in FIGS. 4, 5, and 6. The embodiment of FIG. 1 is regarded as the preferred mode of carrying out this invention. The earring clamp 10 is attached to a decorative jewelry piece 11, with a post 13.

The improved clamp can be set in two positions. The earring clamp 10 is shown in FIG. 1 in an open, or "cocked" position, and in FIG. 2 in a closed or "clamped" position. The earring clamp 10 includes a projecting stud 12, a post receptacle 14, and a pincer jaw 16. The pincer jaw 16 includes a contact surface 18 and a shank 20. The pincer jaw 16 is connected to the post receptacle 14 by a U-shaped spanning arm 22, the connecting portion of the spanning arm 22 being the projecting stud 12. The spanning arm 22 is inserted by the projecting stud 12 into the lower end of the post receptacle 14, and glued or soldered therein. The pincer jaw 16 with contact surface 18 and shank 20 comprises the attachment means for the mounting construction. The spanning arm 22 is the stud projecting from the attachment means and affixed to the receptacle, shown as post receptacle 14.

The earring clamp 10 is operated through use of a leafspring 24. The leafspring 24 is attached to the shank 20 at the shank's upper end by a clamp 26. The leafspring 24 interacts with the spanning arm 22, both to secure the pincer jaw 16 in an open or "cocked" position, and to exert pressure by the contact surface 18 against an earlobe when the pincer jaw 16 is in the closed position on an ear.

The leafspring 24 operates through pressure on a lever 28 extending from the spanning arm 22 as a continuation of spanning arm 22. The spanning arm 22 is pivotally connected to the pincer jaw 16 through axle arms 30 inserted through pivot holes 31. The leafspring 24 exerts pressure on the lever 28, thereby acting to restrain the lever 28 in a position roughly parallel to the shank 20. When the lever 28 is rotated in the pivot holes 31, the lever 28 is restrained in a position perpendicular to the shank 20, thereby lifting the leafspring 24 and "latching" the lever 28 against leafspring 24. Latching occurs when the lever 28 is perpendicular to the leafspring 24, so that the leafspring 24 cannot exert rotational force on the lever 28.

Figure 3:
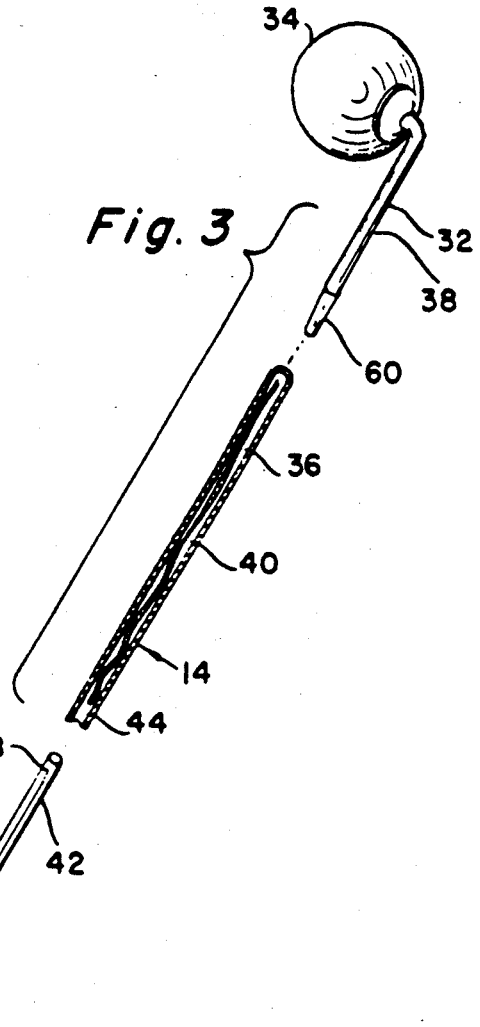
FIG. 3 is a cutaway, side perspective view of the tubular post receptacle, depicting how a pierced-ear earring with an earring post may be inserted into the post receptacle to form a stickpin.

Referring to FIG. 3, the post receptacle 14 is shown in cutaway, and before attachment of the post receptacle to an earring post. FIG. 3 also illustrates an earring post 32 attached to the decorative portion 34 of an earring. FIG. 3 further illustrates a means for releasably securing an earring post 32 within the post receptacle 14. In the preferred embodiment, that means comprises a portion of an elastic, compressible material 36 affixed to the inner surface of the post receptacle 14. In the preferred embodiment, the compressible material is a strand of flexible, compressible fiber, such as polyurethane or plastic fiber. FIG. 3 therefore shows that the earring post 32 may be inserted into the post receptacle 14, causing a friction fit between the outer surface 38 of an earring post and the inner surface 40 of the earring post receptacle. The compression fit also operates through interaction between the outer surface 38 of the earring post and the compressible material 36.

FIG. 3 further illustrates use of the invention as a stickpin. The attachment means is a pin 42 sized to be slidably inserted into the lower end 42 of the post receptacle 14. The pin 42 has a tapered or pointed end 46 so that the pin 42 may be used as the portion of a stickpin that is inserted through clothing or other puncturable material. The upper end 48 of the pin 42 comprises the projecting stud of the attachment means and is therefore insertable in the lower end 44 of the post receptacle. In the preferred embodiment, the upper end 48 is secured within the post receptacle by means of an adhesive bonding agent such as glue. In alternative embodiments, the upper end 48 of the pin 42 can be secured to the lower end 44 of the post receptacle 14 by means of solder, or any other securing means.

Referring to FIGS. 4, 5, and 6, an alternative embodiment is displayed for the post receptacle 14, particularly with use with earrings. FIG. 4 illustrates a side view of an alternative embodiment 50 of the post receptacle. That alternative embodiment consists of a body 50 attached to the spanning arm 22. As shown in FIG. 5 and FIG. 6, the body 50 has an upper end portion which is U-shaped and the bight of the U-shape defines a earring post hole 52 in which an earring post may be inserted.

The earring post hole 52 is oriented so that an earring post inserted through the hole 52 will be aligned parallel to the shank 20 of the pincer jaw 16 when the clamp is in the closed position. As shown in FIG. 5, the legs of the U-shape at the end of body 50 are formed by opposed gripper arms 56 and 54 depending from the portion of the body 50 defining the hole 52. The gripper arms 54 and 56 are positioned in opposed relationship, so that when an earring post, such as that illustrated as 32 in FIG. 3, is inserted through the hole 52, the earring post 32 is aligned approximately parallel to the gripper arms 54 and 56, and is thereby gripped by the lower portions of the gripping arms 54 and 56, to secure the post 32 within the gripper arms 54 and 56.

FIGS. 4, 5, and 6 further illustrate that the alternative embodiment 12 of the earring clamp operates through clamping action upon an ear or other material, with that clamping action applied by the body 50 and contact surface 18 of the pincer jaw 16. As in the preferred embodiment, the alternative embodiment receives its clamping action through operation of a leafspring (not shown) acting on the upper, pivot portion of the spanning arm 22. The pivot portion comprising a pivot hole 31 enclosing a axle arm 30. Again as in the preferred embodiment, the pincer jaw 16 may be latched in the open position, or the closed position as is shown in FIG. 4.

FIG. 3 further illustrates the method by which a pierced-ear earring may be converted to an earring suitable for use on unpierced ears, or to a stickpin. Considering FIG. 3 and FIG. 2, a method of converting pierced earrings begins by providing a clamp such as disclosed in FIG. 2; however, the clamp will not have the post receptacle 14, but would instead have an extended portion (not shown) of the spanning arm 22 constituting a clamping surface opposed to the contact surface 18. The extended portion of the spanning arm 22 is thereafter removed, leaving a clamp, such as is shown in FIG. 2, without the post receptacle 14. An earring post receptacle such as shown in FIGS. 2 and 3 as 14 is then connected to the severed end 58 of the spanning arm 22. The earring post receptacle 14 is then securely affixed to the severed end 58 of the spanning 22, preferably by use of an adhesive bonding agent. Next, a means is provided for securing an earring post in the earring post receptacle 14. In the preferred embodiment, the means comprises a compressible material 36, such as a strand of polyurethane or plastic fiber, glued to the inner surface 40 of the post receptacle 14. The post receptacle 14 may also be sized for a simple friction fit between the outer surface 38 of the earring post and the inner surface 40 of the earring post receptacle. Thereafter, an earring must be prepared for insertion within the post receptacle 14, so that the decorative portion 34 of that earring may be properly displayed. In the preferred embodiment, this preparation comprises bending the earring post so that the decorative portion of the earring 34 is disposed away from the earring post 32. The preparation may also include the tapering the lower end 60 of the earring post 32, to ease insertion of the earring post 32 into the post receptacle 14. If the pierced-ear earring has a hook, rather than a post, the hook must be mechanically straightened to form a post.

Figure 7:
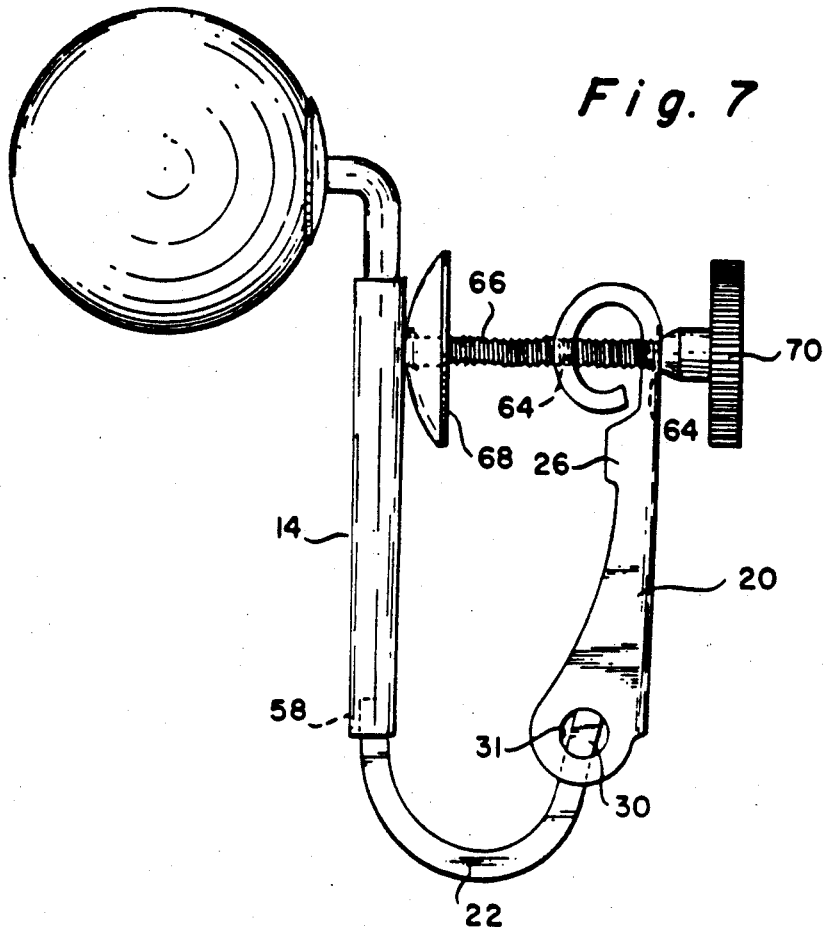
FIG. 7 is a side perspective view of a third embodient of the improved earring clamp.

Referring to FIG. 7, a further alternative embodiment of the earring clamp is illustrated. Like the preferred embodiment, the embodiment illustrated in FIG. 7 contains a post receptacle 14 fixed to the severed end 58 of the spanning arm 22. Also as in the preferred embodiment, the alternative embodiment shown in FIG. 7 uses a lever 28 on the end of the spanning arm 22 interacting with the leaf spring to urge a shank 20 against the post receptacle 14; the leaf spring 24 is also attached to the shank 20 by a clamp 26, and the shank 20 rotates about axle arms 30 on the end of spanning arm 22, with the axle arms 30 extending through pivot holes 31 in the shank 20.

The alternative embodiment displayed in FIG. 7 differs from the preferred embodiment in that the upper end of the spanning arm 20 comprises a loop 62 pierced by a threaded bore 64 in the opposed sides of the loop. A tightening bolt 66 is threaded through the threaded bore 64 so that rotation of the tightening bolt urges the bolt towards or away from the post receptacle 14 when the shank 20 is in the closed position. A contact surface 68 is affixed to the tightening bolt 66 at its end nearest the post receptacle 14. A tightening handle 70 is affixed to the tightening bolt 66 at the tightening bolt's opposite end. In operation, manual rotation of the tightening handle 70 urges the tightening bolt 66 and contact surface 68 towards or away from the post receptacle 14, thereby increasing or decreasing the clamping pressure between the post receptacle 14 and the contact surface 68 when the shank 20 is in the closed position and the clamping mechanism is clamped on a body portion such as an ear lobe.

Figure 8:
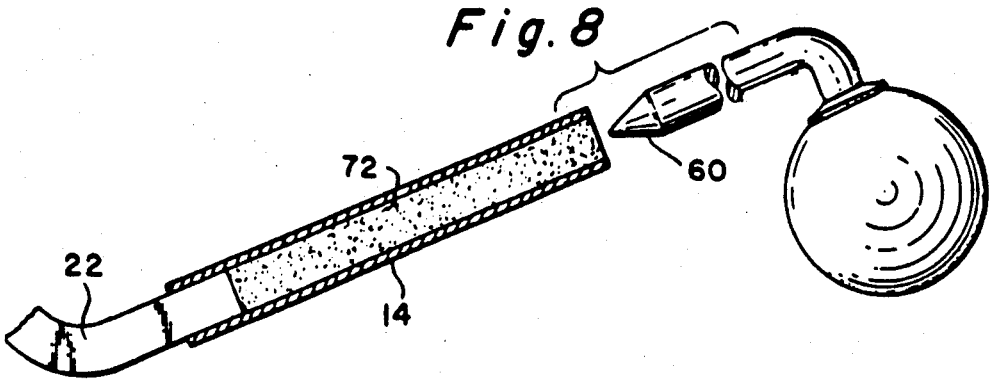
FIG. 8 is a cutaway, side perspective view of a second embodiment of the tubular post receptacle and means for securing an earring post in the receptacle.

Referring to FIG. 8, an alternative embodiment of the means for securing the earring post to the post receptacle is illustrated. As in the preferred embodiment, the alternative embodiment shown in FIG. 8 includes a spanning arm 22 affixed within the post receptacle 14. Unlike the preferred embodiment, the friction means for securing the earring post 60 in the post receptacle 14 is a yieldable and puncturable elastic material such as an adhesive 72 inserted within the post receptacle 14. The adhesive 72 is preferably a silicone glue, such as is commonly used in many household adhesive compounds. Insertion of an earring post 60 in the post receptacle 14 then displaces portions of the adhesive 72, creating a friction fit between the outer surface of the earring post 60 and the inner surface of the post receptacle 14, thereby securing the earring post 60 against longitudinal movement within the post receptacle 14.

While preferred embodiments of the present invention have been set forth in the above detailed description, it is to be understood that the invention is limited only by the following claims and their equivalents.

What is claimed is:

1. An improved jewelry mounting construction for adapting a pierced-ear earring for use as a stickpin, the earring being of the kind having a smooth surfaced, linear earring post with an attached decorative piece, the construction comprising, in combination:

an earring post receptacle defining a generally cylindrical smooth sided bore compatable with the earring post and adapted for slidable insertion and removal of an earring post into and out of the bore;

means for frictionally mounting the earring post within the post receptacle bore to restrain sliding insertion and removal of the earring post and attach the post within the bore, said means comprising an elastic material contained within the bore of the receptacle to retain the earring post within the bore by a friction fit; and an elongated decorative pin affixed to the receptacle and having upper and lower longitudinal ends, the lower end of the pin tapering generally to a point for insertion of the pin into clothing and retain the pin in the clothing, the upper end of the pin being affixed to the earring post receptacle to prevent movement between the pin and the receptacle, the pin being of a length sufficient to support the post receptacle in the clothing and to restrict motion of the pin in the clothing when interwoven into that clothing by puncturing insertion by the lower tapered end whereby a pierced-ear earring having a decorative piece may be inserted by its earring post into the earring post receptacle and the combination of the elongated post receptacle and the elongated pin may be inserted into and restrained within clothing so that a pierced-ear earring may be used as a stickpin.

2. An improved jewelry mounting construction as claimed in claim 1, wherein the elastic material further comprises an elastomeric silicone adhesive.

3. A jewelry mounting construction for adapting a pierced-ear earring for use as a clothing stickpin when the pierced-ear earring has an elongated smooth-sided cylindrical earring post intended for insertion at one end through the lobe of a pierced-ear, the pierced-ear earring also having a decorative piece affixed to the other end of the post, the construction comprising, in combination:

a tubular earring post receptacle having a smooth inner surface and adapted to mate with the cylindrical earring post by sliding insertion of the earring post into one end of the receptacle, the receptacle being configured with a point at the other end and being of sufficient length to support the construction when the pointed end is inserted into clothing; and means for securing the earring post in the receptacle by a friction fit, the means comprising an elastic material filling a portion of the receptacle and affixed to the inner surface of the receptacle, the elastic material being puncturable and yieldable upon insertion of the earring post into the receptacle, whereby a pierced-ear earring may be converted into a stickpin by inserting the elongated smooth-sided earring post into the tubular earring post receptacle such that the earring post is held within the receptacle by a friction fit from the adherance of the smooth sides of the earring post to the elastic material within the receptacle, and the construction may be mounted on clothing as a decoration by inserting the pointed end of the receptacle into the clothing.

4. A jewelry mounting construction as claimed in claim 3, wherein the elastic material comprises an elastomeric silicone adhesive.

* * * * *